US010160615B2

(12) United States Patent
Jo et al.

(10) Patent No.: US 10,160,615 B2
(45) Date of Patent: Dec. 25, 2018

(54) ROLL HOLDING APPARATUS

(71) Applicant: Brother Kogyo Kabushiki Kaisha, Nagoya-shi, Aichi-ken (JP)

(72) Inventors: Hidenori Jo, Nagoya (JP); Keiji Seo, Nagoya (JP); Takamine Hokazono, Kasugai (JP); Kenji Kurita, Kariya (JP); Hitoshi Sanada, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/055,976

(22) Filed: Feb. 29, 2016

(65) Prior Publication Data

US 2016/0288485 A1 Oct. 6, 2016

(30) Foreign Application Priority Data

Mar. 31, 2015 (JP) ..... 2015-074151

(51) Int. Cl.
*B65H 19/12* (2006.01)

(52) U.S. Cl.
CPC . *B65H 19/126* (2013.01); *B65H 2301/41346* (2013.01); *B65H 2402/441* (2013.01); *B65H 2402/442* (2013.01); *B65H 2801/12* (2013.01)

(58) Field of Classification Search
CPC ..... B65H 19/126; B65H 2301/41346; B65H 2402/52211; B65H 2402/5221; B65H 2402/442; B65H 2801/12; B65H 2402/441
See application file for complete search history.

(56) References Cited

U.S. PATENT DOCUMENTS 3,743,198 A * 7/1973 Lucas ..... B65H 19/126 242/559.1
5,322,234 A * 6/1994 Robert ..... A47K 10/40 242/596.7

(Continued)

FOREIGN PATENT DOCUMENTS

JP H09-150996 A 6/1997
JP H10-181956 A 7/1998

(Continued)

OTHER PUBLICATIONS

Sep. 26, 2017—(JP) Notification of Reasons for Refusal—App 2015-074151, Eng App.

*Primary Examiner* — Leslie J Evanisko
*Assistant Examiner* — Marissa Ferguson Samreth
(74) *Attorney, Agent, or Firm* — Banner & Witcoff, Ltd.

(57) ABSTRACT

A roll holding apparatus includes a pair of holding members and an advancing/retracting support device. The pair of holding members is configured to be inserted into an inner periphery of a print-receiving paper roll. The pair of holding members is configured to rotatably support the print-receiving paper roll. The advancing/retracting support device is configured to support the holding member to switch an advancing/retracting state of the holding member into a first state, second state, or a third state. A tip end portion of the holding member protrudes to a first position in the first state. The tip end portion lies inward along an axial direction of the print-receiving paper roll than the first position in the second state. The tip end portion lies outward along the axial direction from the first position in the third state.

3 Claims, 11 Drawing Sheets

(56) References Cited

U.S. PATENT DOCUMENTS

| | | | | | |
|---|---|---|---|---|---|
| 5,813,343 | A * | 9/1998 | Harb | B65H 16/06 | 101/212 |
| 9,505,248 | B2 * | 11/2016 | Kurita | B41J 29/02 | |
| 9,731,921 | B2 * | 8/2017 | Howard | B65H 19/126 | |
| 2006/0163418 | A1 * | 7/2006 | Ko | A47K 10/40 | 242/596.4 |
| 2008/0011805 | A1 * | 1/2008 | Genta | B65H 19/126 | 226/51 |
| 2008/0135674 | A1 | 6/2008 | Takeuchi | | |
| 2009/0212152 | A1 * | 8/2009 | Ozaki | B65H 16/06 | 242/596.4 |
| 2011/0170929 | A1 * | 7/2011 | Nakayama | B41J 15/042 | 400/619 |
| 2014/0186086 | A1 | 7/2014 | Yato | | |

FOREIGN PATENT DOCUMENTS

| | | | | | |
|---|---|---|---|---|---|
| JP | 2008-114983 | A | | 5/2008 | |
| JP | 2010-036989 | A | | 2/2010 | |
| JP | 2013-220878 | A | | 10/2013 | |
| JP | 2014-125330 | A | | 7/2014 | |
| JP | 2015009439 | | * | 1/2015 | B41J 15/04 |
| WO | 2005108254 | | * | 11/2005 | B65H 16/06 |

* cited by examiner

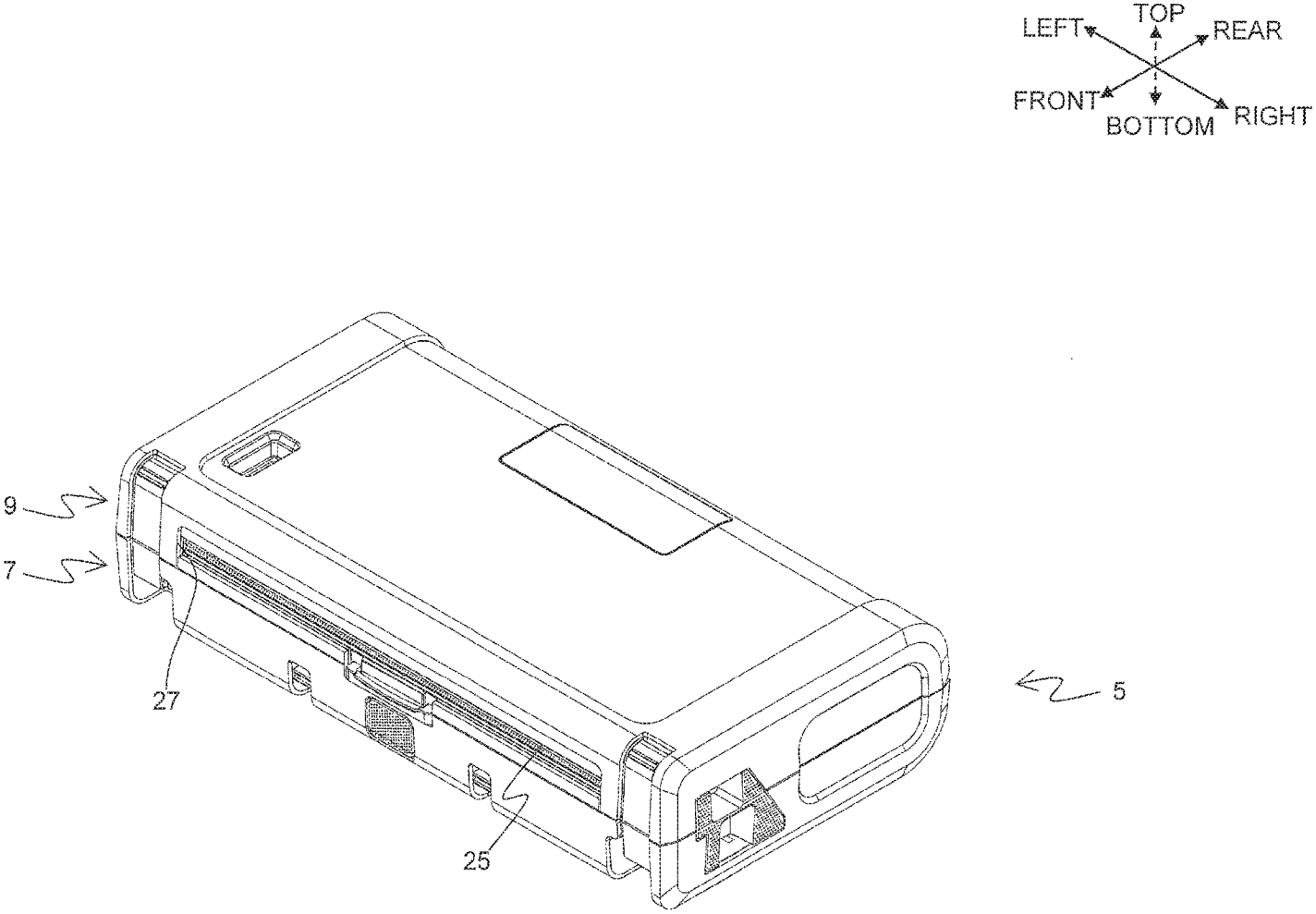
[FIG. 1]

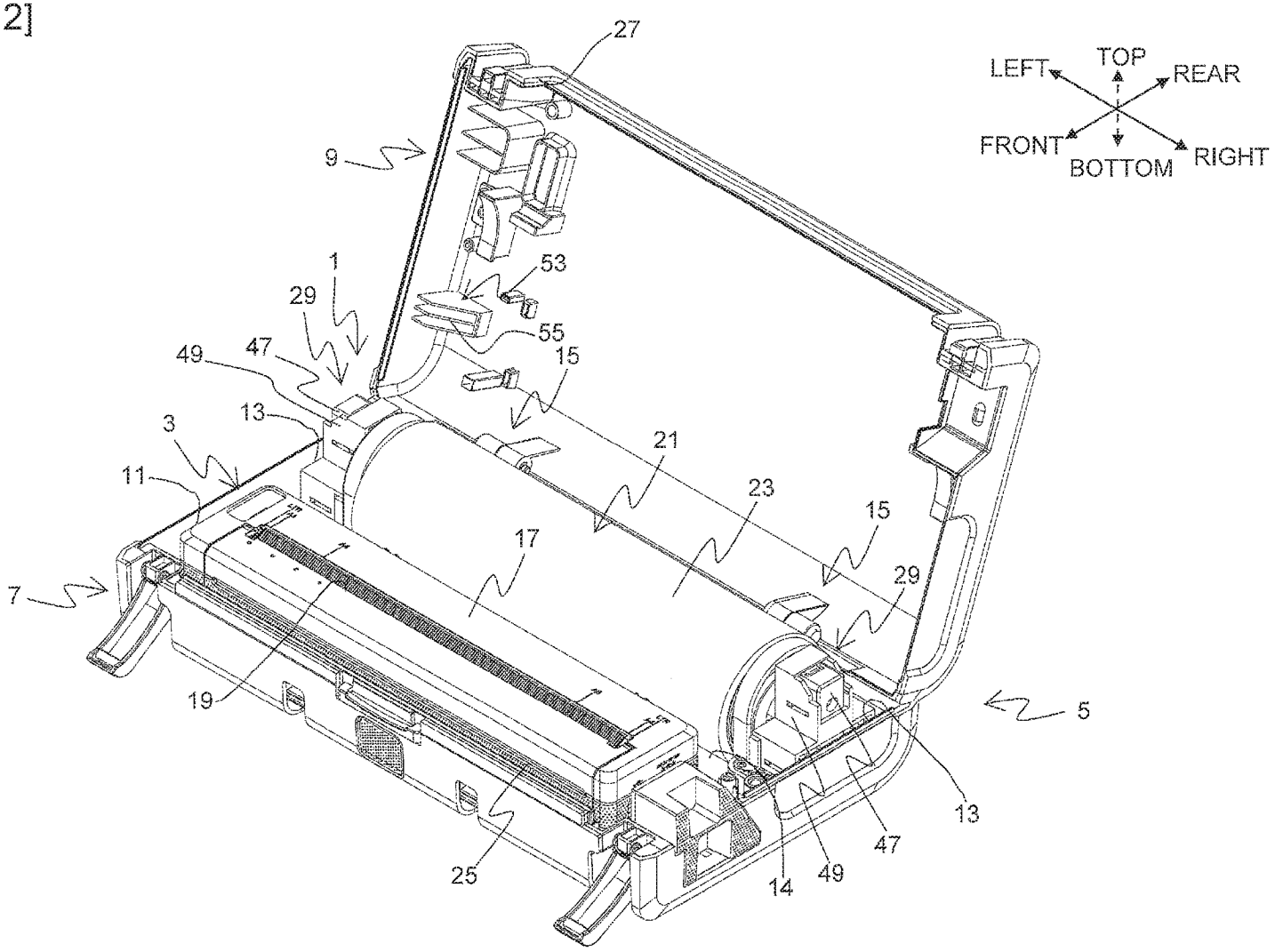
[FIG. 2]

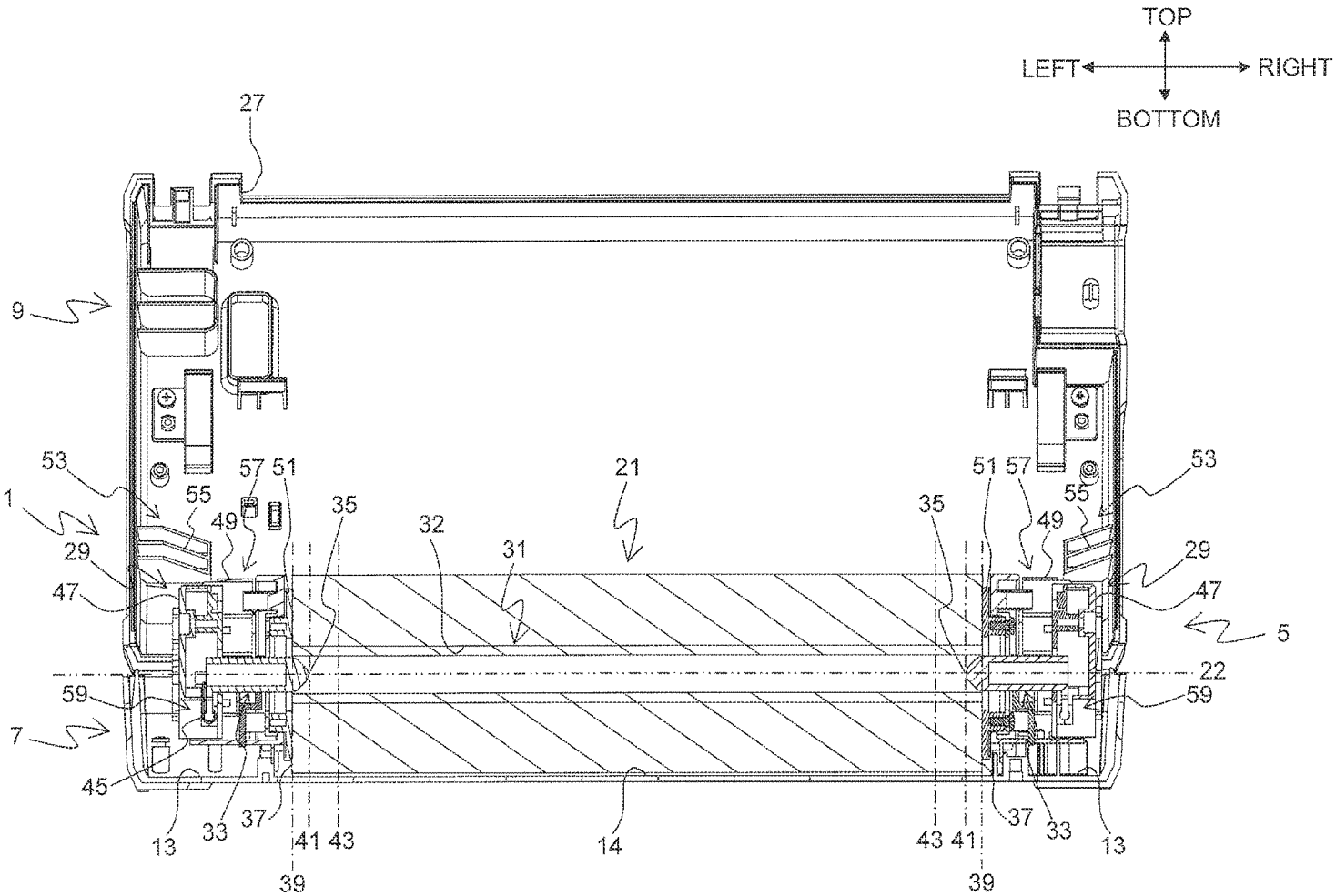
[FIG. 3]

[FIG. 4]
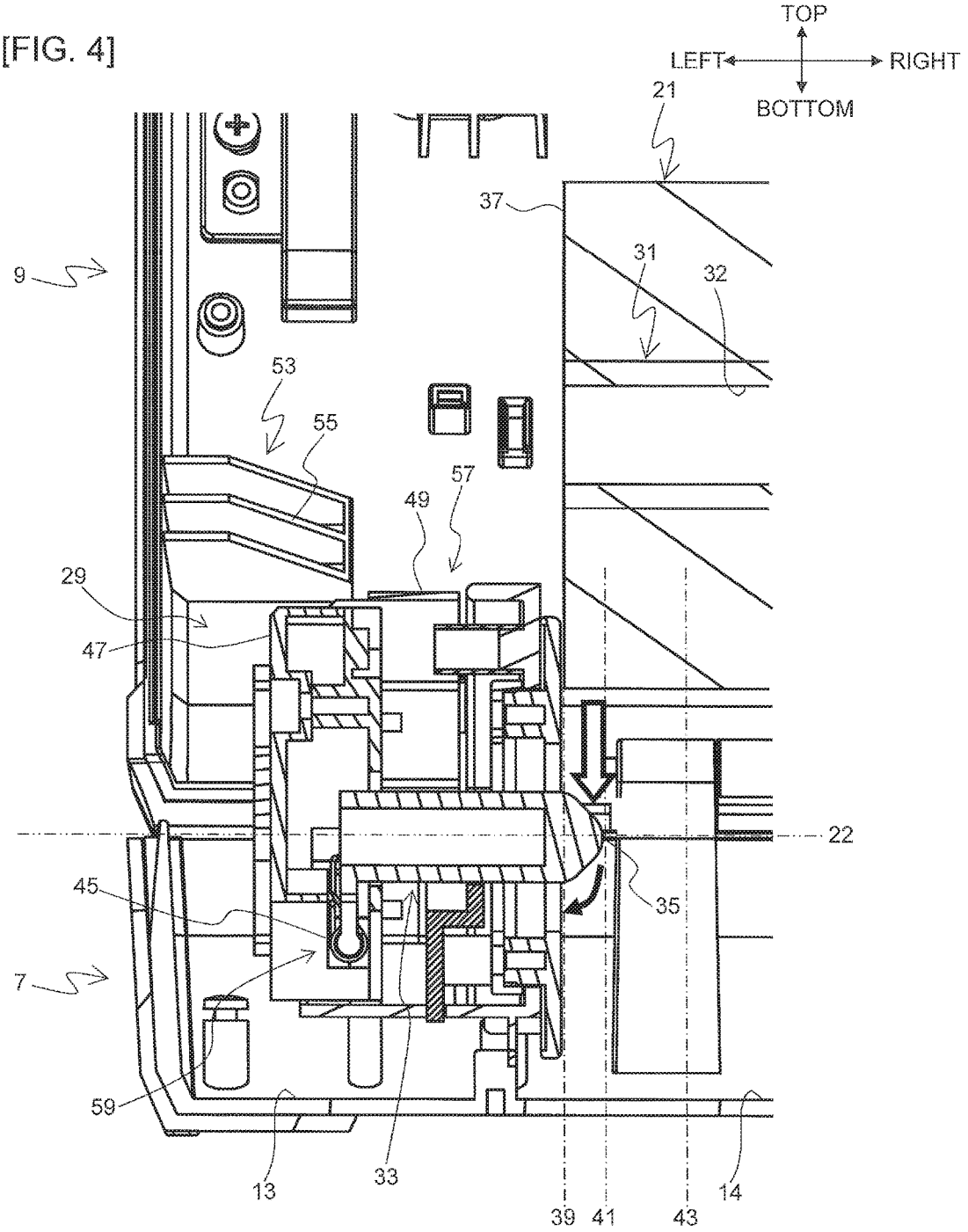

[FIG. 5]
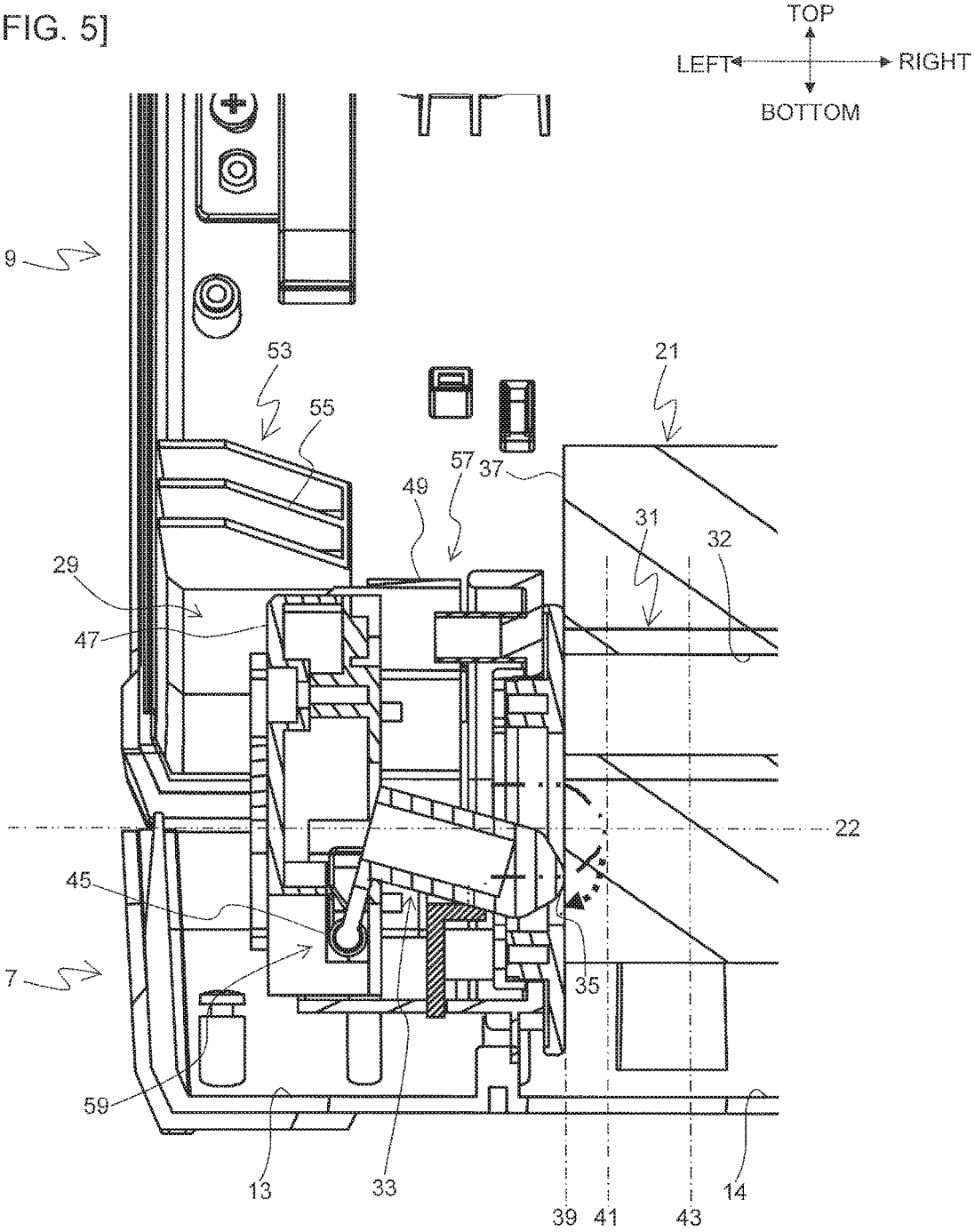

[FIG. 6]
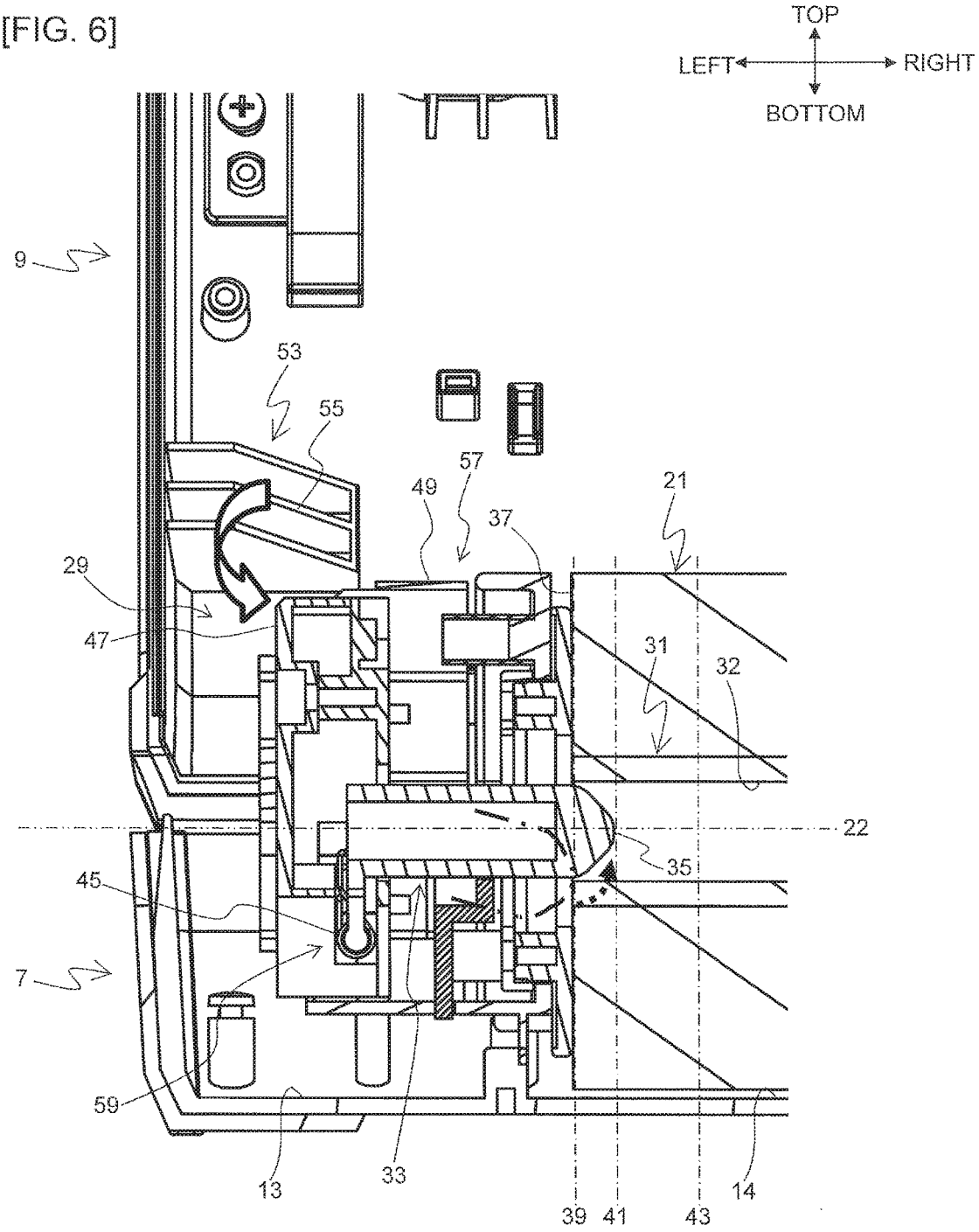

[FIG. 7]
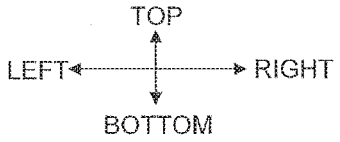
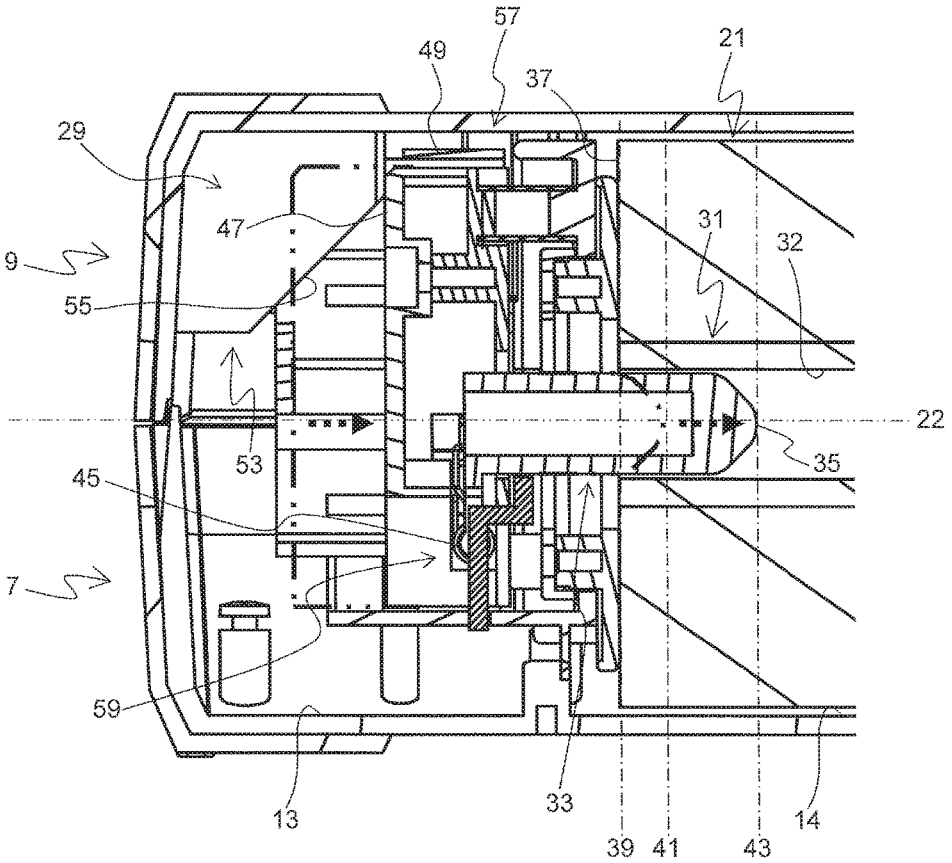

[FIG. 8]
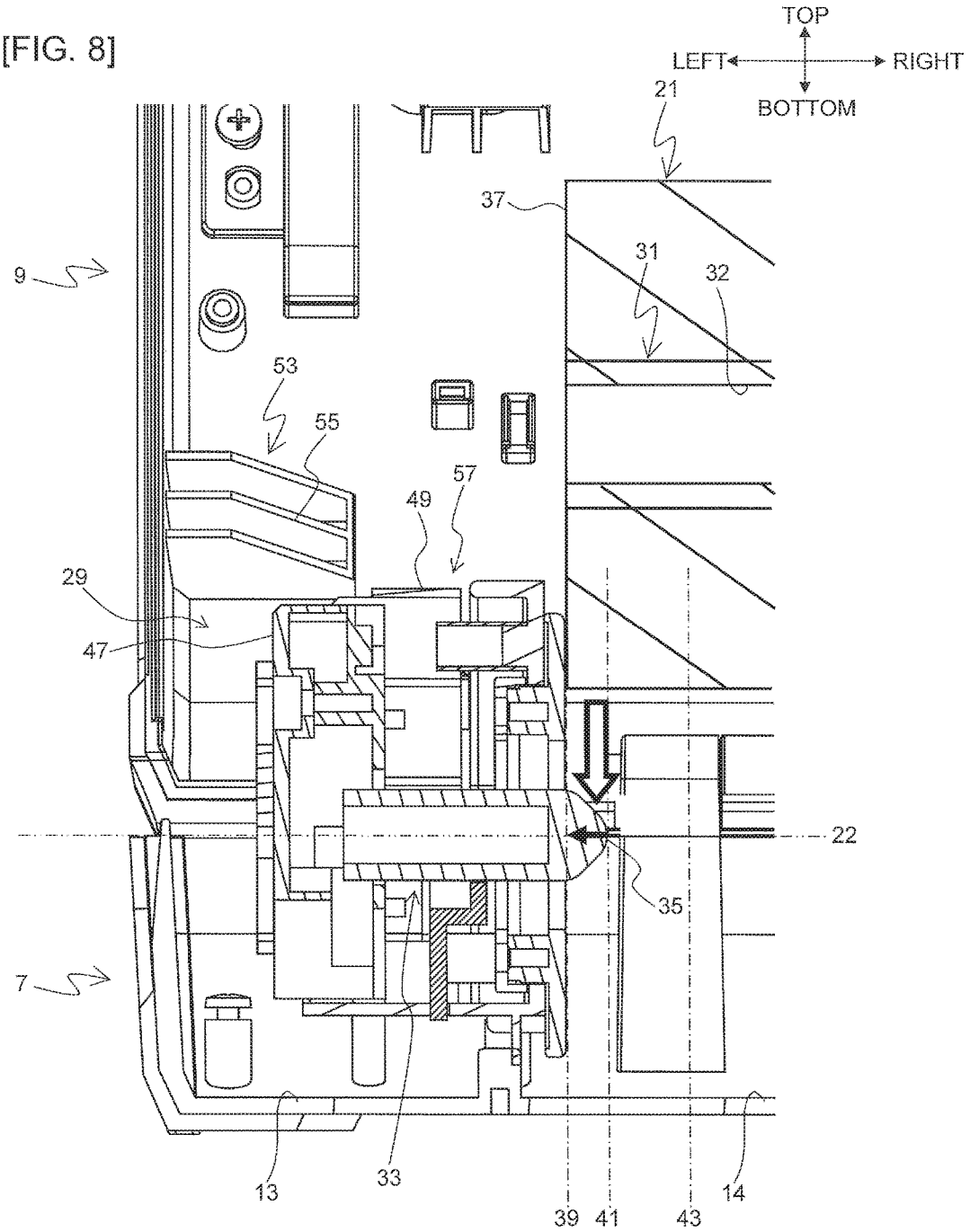

[FIG. 9]
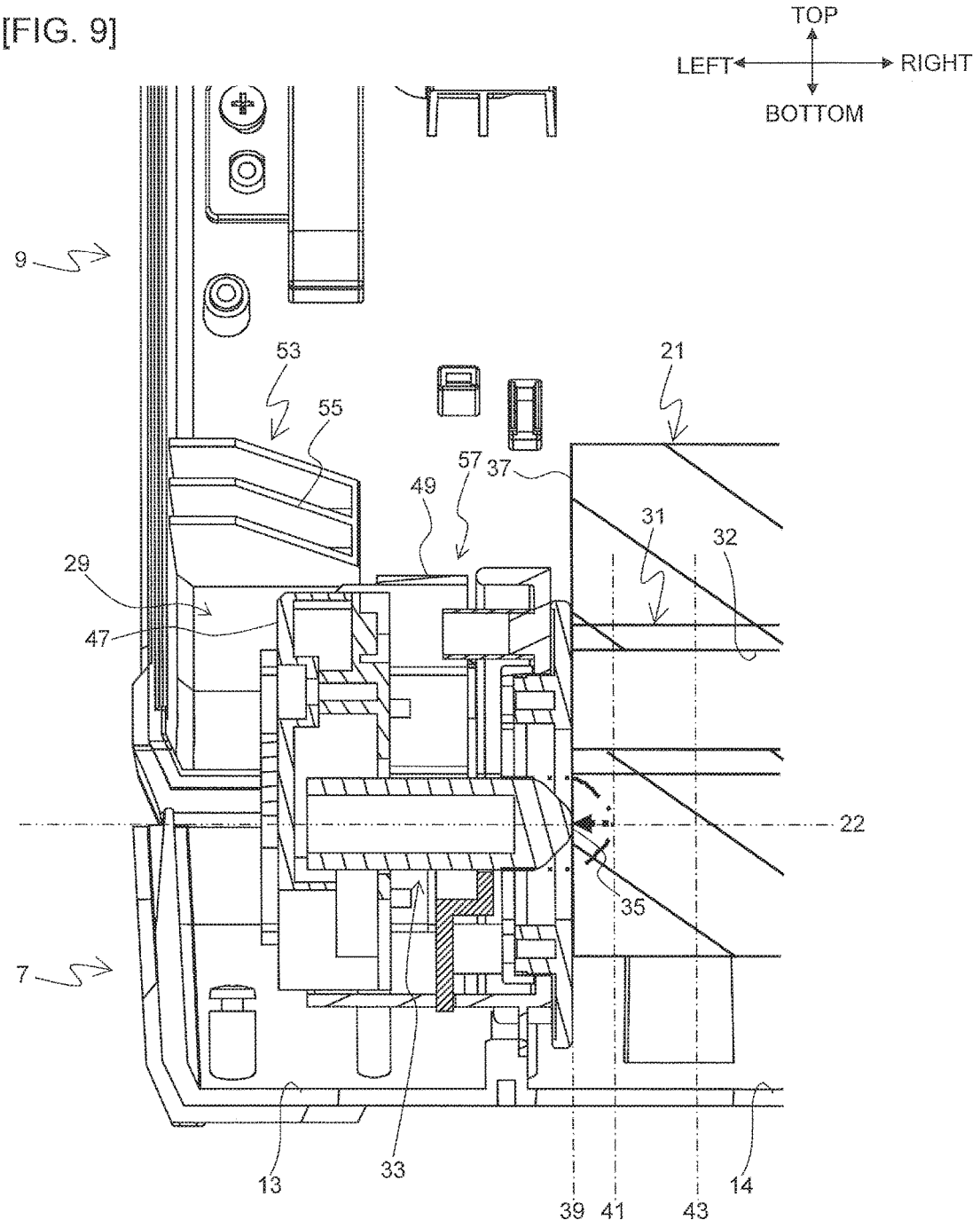

[FIG. 10]
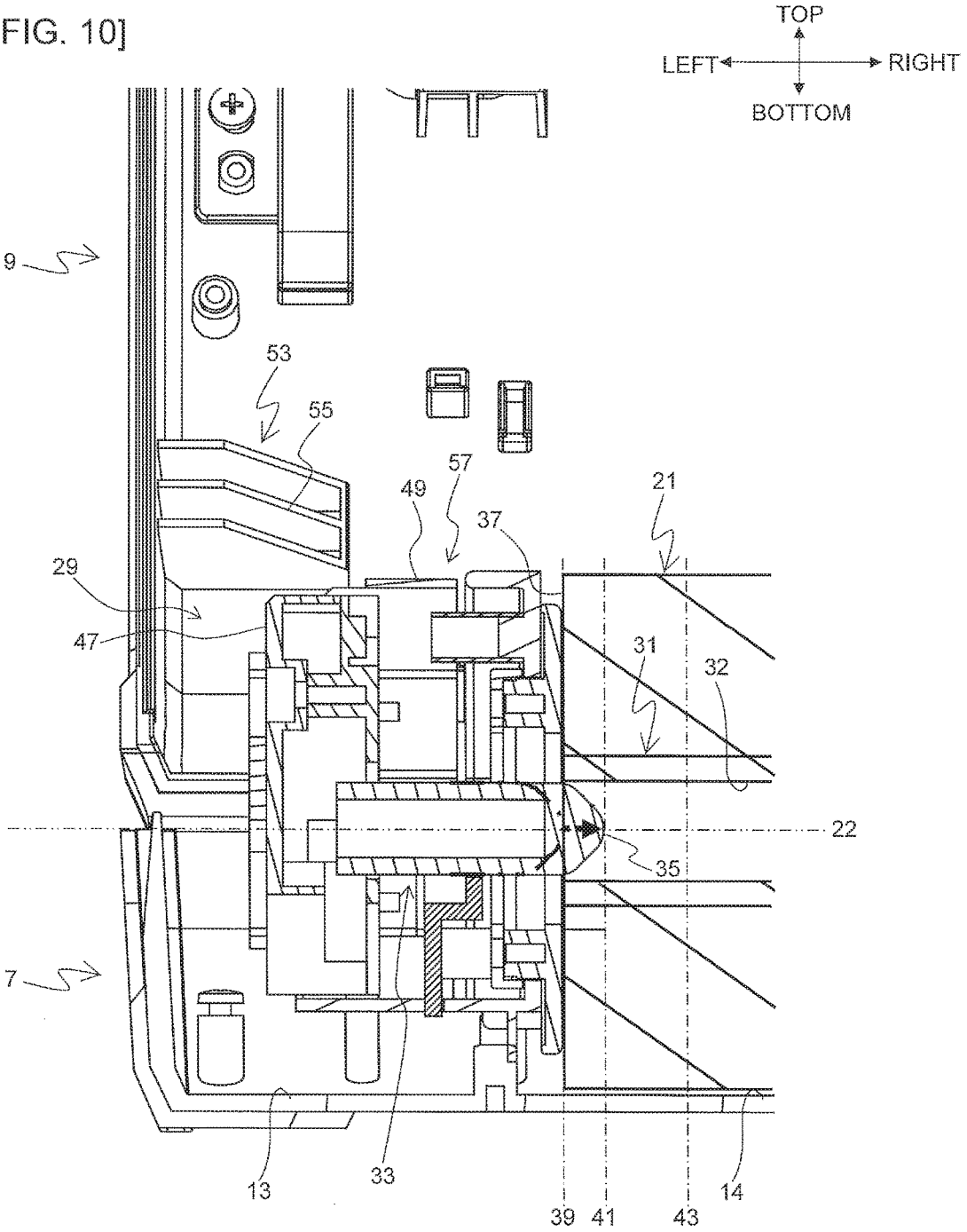

[FIG. 11]
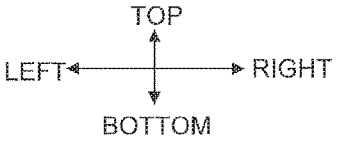
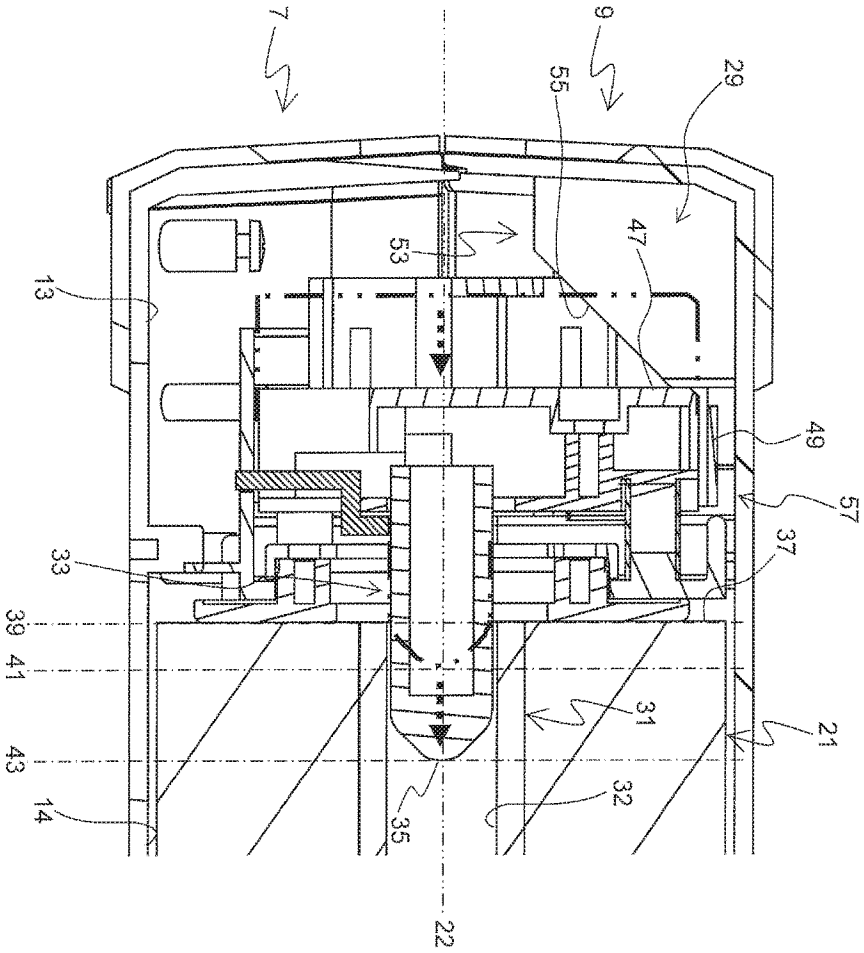

ROLL HOLDING APPARATUS

CROSS-REFERENCE TO RELATED APPLICATION

The present application claims priority from Japanese Patent Application No. 2015-74151, which was filed on Mar. 31, 2015, the disclosure of which is incorporated herein by reference in its entirety.

BACKGROUND

Field

The present disclosure relates to a roll holding apparatus capable of holding a print-receiving paper roll in the form of rolled-up print-receiving paper to be fed to a printer.

Description of the Related Art

A structure has hitherto been known that is capable of holding a print-receiving paper roll in the form of rolled-up print-receiving paper to be fed to a printer. In this prior art, a pair of holding members (holing rib protruding portions) are inserted into the inner periphery (core through hole) of the print-receiving paper roll (rolled paper) so that the print-receiving paper roll can rotatably be held.

In the above described prior art, a protruding length of the holding members into the print-receiving paper roll inner periphery is a fixed value. For this reason, for example, if the above described protruding length of the holding members is set shorter, the force holding the print-receiving paper roll weakens in spite of a good operability upon mounting the print-receiving paper roll. On the other hand, if the above described protruding length of the holding members is set longer, the operability upon mounting the print-receiving paper roll is impaired in spite of a good holding force for the print-receiving paper roll.

SUMMARY

It is therefore an object of the present disclosure to provide a roll holding apparatus capable of securely holding a print-receiving paper roll without impairing the operability upon the mounting of the print-receiving paper roll.

In order to achieve the above-described object, according to aspect of the present application, there is provided a roll holding apparatus comprising a pair of holding members that is arranged in a manner facing each other, and is configured to be inserted into an inner periphery of a print-receiving paper roll that includes an outer periphery around which a print-receiving paper to be fed to a printer is wound and configured to rotatably support the print-receiving paper roll, and an advancing/retracting support device configured to support the holding member to switch an advancing/retracting state of the holding member into a first state where a tip end portion of the holding member protrudes to a first position, a second state where the tip end portion lies inward along an axial direction of the print-receiving paper roll than the first position, or a third state where the tip end portion lies outward along the axial direction from the first position.

The roll holding apparatus of the present disclosure is capable of rotatably holding the print-receiving paper roll by inserting the pair of holding members into the inner periphery of the print-receiving paper roll in the form of rolled-up print-receiving paper to be fed to the printer. The holding members are supported in an advanceable and retractable manner by the advancing/retracting support device. The advancing/retracting support device is capable of switching the advancing/retracting state of the holding members into three states, i.e., a first state, a third state, and a second state. The first state is, for example, a state where the tip end portions of the holding members protrude to first positions (e.g., positions in the vicinity of positions of axially end surfaces) axially inward from positions of axially end surfaces of the print-receiving paper roll. The third state is a state where the tip end portions of the holding members lie at the above described positions of the axially end surfaces or axially outward therefrom. The second state is, for example, a state where the tip end portions of the holding members protrude to second positions (e.g., positions apart to some extent from the positions of the axially end surfaces) axially further inward from the above described first positions.

When mounting the print-receiving paper roll for example, the advancing/retracting support device first retracts the holding members from the print-receiving paper roll as the third state, and then inserts slightly into the inner periphery of the print-receiving paper roll as the first state, whereby the print-receiving paper roll can temporarily be held while preventing the holding members from interfering with the print-receiving paper roll mounting action. When a case cover is in the closed-state for example, the advancing/retracting support device inserts the holding members to a large extent into the print-receiving paper roll inner periphery as the second state, whereby the print-receiving paper roll can steadily be held.

As described above, by enabling the holding members to be switched to the above described three states, the print-receiving paper roll can securely be held without impairing the operability at the time of mounting the print-receiving paper roll.

BRIEF DESCRIPTION OF THE DRAWINGS

FIG. 1 is a perspective view showing the state where a case cover is closed, for explaining schematic configurations of a roll holding apparatus according to an embodiment of the present disclosure and its surroundings.

FIG. 2 is a perspective view showing the state where a case cover is opened, for explaining the schematic configurations of the roll holding apparatus and its surroundings.

FIG. 3 is a cross-sectional view for explaining the schematic configurations of the roll holding apparatus and its surroundings.

FIG. 4 is a cross-sectional view showing the pre-mounting state of a print-receiving paper roll, for explaining the action of the roll holding apparatus.

FIG. 5 is a cross-sectional view showing the mounting state of the print-receiving paper roll, for explaining the action of the roll holding apparatus.

FIG. 6 is a cross-sectional view showing the mounting completion state of the print-receiving paper roll, for explaining the action of the roll holding apparatus.

FIG. 7 is a cross-sectional view showing the state where the case cover is closed, for explaining the action of the roll holding apparatus.

FIG. 8 is a cross-sectional view showing the pre-mounting state of the print-receiving paper roll, for explaining the action of the roll holding apparatus, in a modification example excluding a swing support mechanism.

FIG. 9 is a cross-sectional view showing the mounting state of the print-receiving paper roll, for explaining the action of the roll holding apparatus, in the modification example excluding the swing support mechanism.

FIG. 10 is a cross-sectional view showing the mounting completion state of the print-receiving paper roll, for explaining the action of the roll holding apparatus, in the modification example excluding the swing support mechanism.

FIG. 11 is a cross-sectional view showing the state where the case cover is closed, for explaining the action of the roll holding apparatus, in the modification example excluding the swing support mechanism.

DETAILED DESCRIPTION OF THE PREFERRED EMBODIMENTS

An embodiment of the present disclosure will now be described with reference to the drawings. In the case that there are notes on terms "front", "rear", "left", "right", "top", and "bottom" in the drawings, the "front", "rear", "left", "right", "top", and "bottom" in the description of this specification refer to the directions indicated by the notes.

<Schematic Configurations of Roll Holding Apparatus and its Surroundings>

First, referring to FIGS. 1 to 3, schematic configurations of a roll holding apparatus of this embodiment and its surroundings will be described.

As shown in FIGS. 1 to 3, the roll holding apparatus designated at 1 of this embodiment is disposed in a case 5 storing a handheld printer 3.

The case 5 has a case body 7 of a substantially rectangular shape in planar view, and a case cover 9 of a substantially rectangular shape in planar view.

The case body 7 includes therein a first storage part 11, two attachment parts 13, 13, and a second storage part 14.

The first storage part 11 is disposed along the left and right directions that are horizontal directions on the forward side, i.e., the front side within the case body 7. The first storage part 11 stores the printer 3 transversely such that a feed port 19 described later faces the top side that is the ceiling side and such that a discharge port 25 described later faces the front side.

The attachment parts 13, 13 are disposed on left and right ends on the rear side that is the backward side within the case body 7. A pair of holding mechanisms 29, 29 of the roll holding apparatus 1 are attached to the attachment parts 13, 13 (in other words, surfaces of the case body 7) so as to face each other.

The second storage part is disposed between the attachment parts 13, 13 within the case body 7. A print-receiving paper roll 21, obtained by rolling print-receiving paper 23 into a roll around the outer periphery of a core 31, is received in the second storage part 14 from above and stored therein while being mounted on the above described roll holding apparatus 1 in such a manner that an axis 22 in the axial direction of the roll (width direction of the print-receiving paper 23) extends in the left and right directions.

The case cover 9 is supported by hinge parts 15, 15 disposed on the rear end sides of the case 5 in such a manner as to be openable and closable with respect to the case body 7. The case cover 9 is pivotable between a closed position (position shown in FIG. 1) and an open position (position shown in FIGS. 2 and 3).

The printer 3 has a substantially rectangular parallelepiped-shaped housing 17. The feed port 19 is disposed on the top surface of the housing 17 so that the print-receiving paper 23 fed out from the print-receiving paper roll 21 as described later is fed through the feed port 19 into the interior of the housing 17. A conveying roller (not shown) conveying the fed print-receiving paper 23 along a predetermined feeding path, a print head (not shown) forming a desired print on the conveyed print-receiving paper 23, etc., are disposed in the housing 17. The discharge port 25 is disposed on the front surface of the housing 17 so that printed paper, i.e., the print-receiving paper 23 having a print formed thereon is discharged through the discharge port 25 to the exterior of the housing 17.

An opening 27 is disposed on a front surface (surface forming a front in the state where the case cover 9 is in the closed position) of the case cover 9 at a position corresponding to the position of the above described discharge port 25 of the case 5 so that the above described printed paper discharged from the discharge port 25 to the exterior of the housing 17 is discharged through the opening 27 to the exterior of the case 5.

The roll holding apparatus 1 is an apparatus for holding the above described print-receiving paper roll 21 rotatably. The print-receiving paper roll 21 is mounted on the roll holding apparatus 1 in such a manner that the above described axis 22 extends in the left and right directions. The print-receiving paper roll 21 is held rotatably about the axis 22 by the roll holding apparatus 1, to feed out the print-receiving paper 23.

<Configuration of Roll Holding Apparatus>

The roll holding apparatus 1 includes the pair of holding mechanisms 29, 29 each having a rod-like holding member (shaft) 33.

By attaching the holding mechanisms 29, 29 to the attachment parts 13, 13, the holding members 33, 33 are arranged facing each other in the left and right directions. The holding members 33, 33 are members (shafts) inserted, from left and right end sides, into an inner periphery 32 of the core 31 of the print-receiving paper roll 21 received in the above described second storage part 14 from above, and capable of holding the print-receiving paper roll 21 rotatably about the axis 22. The holding members 33 are supported in an advanceable and retractable manner in the holding mechanisms 29, respectively, and their respective advancing/retracting state is switched into three states, i.e., a first state, a second state, and a third state.

The first state is a state (state shown in FIGS. 2 and 3 and in FIGS. 4 and 6 described later) in which tapered tip end portions 35 of the holding members 33 protrude to respective first positions 41. In this first state, when assuming a plane entirely containing a flange 51 of the holding mechanism 29, the above described tip end portion 35 has a positional relationship penetrating the imaginary plane. The first position 41 in relation to the left-hand holding member 33 is a position on the right-hand side of a left end surface position 39 that is a position corresponding to a left end surface 37 of the print-receiving paper roll 21 when received in the second storage part 14, and is a position relatively closer to the left end surface position 39. The first position 41 in relation to the right-hand holding member 33 is a position on the left-hand side of a right end surface position 39 that is a position corresponding to a right end surface 37 of the print-receiving paper roll 21 when received in the second storage part 14, and is a position relatively closer to the right end surface position 39. Hereinafter, properly, the left end surface 37 and the right end surface 37 are referred generically to as "end surface 37", and the left end surface position 39 and the right end surface position 39 are referred generically to as "end surface position 39".

The third state is a state (state shown in FIG. 5 described later) in which the tip end portions 35 lie at the end surface positions 39, respectively, or axially outward therefrom (on the left-hand side thereof for the left-hand holding mechanism 29, and on the right-hand side thereof for the right-hand holding mechanism 29).

The second state is a state (state shown in FIG. 7 described later) in which the tip end portions 35 protrude to second positions 43, respectively. The second position 43 in relation to the left-hand holding member 33 is a position further rightward from the first position 41 on the right-hand side of the left end surface position 39, and is a position apart to some extent from the left end surface position 39. The second position 43 in relation to the right-hand holding member 33 is a position further leftward from the first position 41 on the left-hand side of the right end surface position 39, and is a position apart to some extent from the right end surface position 39.

Each of the holding mechanisms 29 includes the above described holding member 33, the above described flange 51, a slide support mechanism 57, and a swing support mechanism 59.

The flange 51 faces the end surface 37 of the print-receiving paper roll 21 stored in the second storage part 14. The left and right flanges 51, 51 face each other.

The slide support mechanism 57 and the swing support mechanism 59 are configured to support the holding member 33 in an advanceable and retractable manner to enable the advancing/retracting state of the holding member 33 to be switched into the above described first state, second state, and third state.

The slide support mechanism 57 is configured to support the holding member 33 slidably in the left and right directions to enable the advancing/retracting state of the holding member 33 to be switched into the above described first state and second state. The slide support mechanism 57 includes a guide member 49, a slide member 47, and a spring (slide spring, not shown).

The guide member 49 has its interior extending along the left and right directions.

The slide member 47 is disposed within the guide member 49 and is supported by the guide member 49 slidably in the left and right directions relative to the guide member 49. The holding member 33 is coupled to the slide member 47 so as to move in the same direction together with the slide of the slide member 47.

The slide member 47 is urged outward in the left and right directions by the above described spring, and, when subjected to no external force, is moved to the outermost position in the left and right directions (in other words, the direction of the above described axis 22) along the above described guide member 49 by an urging force of the above described spring. When the slide member 47 is moved to the outermost position in the left and right directions, the holding member 33 is in the above described first state (if no external force is applied). At this time, the central axes of the left and right holding members 33, 33 are coaxial with each other (lie on the axis 22). When as a result of being subjected to an external force, the slide member 47 slides inward in the left and right directions (rightward for the left-hand holding mechanism 29, leftward for the right-hand holding mechanism 29) relative to the guide member 49 against the urging force of the spring, the holding member 33 also simultaneously moves inward in the left and right directions. When the slide member 47 is moved to the innermost position in the left and right directions, the holding member 33 is in the above described second state (if no external force is applied).

In this embodiment, the slide support mechanism 57 causes the holding member 33 to slide in conjunction with the opening/closing action of the above described case cover 9. Protrusions 53, 53 acting as members applying an external force to the slide members 47, 47 are disposed on portions of the case cover 9 corresponding to the slide members 47, 47. The protrusions 53 are each configured to come into pressure contact with the upper end of each of the slide members 47 when the case cover 9 is closed.

The swing support mechanism 59 is configured to support the holding member 33 in a swingable manner to enable the advancing/retracting state of the holding member 33 to be switched into the above described first state and third state. The swing support mechanism 59 includes a coil spring 45. In FIG. 3, the coil spring 45 of the right-hand holding mechanism 29 is not shown.

The coil spring 45 is disposed to couple the holding member 33 and the above described slide member 47 and urges the holding member 33 so as to direct it along the left and right directions, that is, so as to be in the above described first state (if no external force acts on the above described slide member 47). In the state where the holding member 33 is subjected to no external force, the holding member 33 is in the above described first state (if no external force is applied to the above described slide member 47) by the urging force of the coil spring 45. When the holding member 33 is subjected to any external force, the holding member 33 is swung against the urging force of the coil spring 45, (if no external force is applied to the slide member 47) resulting in the above described third state (state where the tip end portion 35 enters the interior of the holding mechanism 29).

<Actions of Roll Holding Apparatus>

Referring to FIGS. 4 to 7, actions of the roll holding apparatus 1 will then be described. FIGS. 4 to 7 show, as representative, actions of the left-hand holding mechanism 29 between the pair of holding mechanisms 29, 29.

In FIGS. 4 to 7, in the state where the print-receiving paper roll 21 is not mounted, with the case cover 9 opened, the slide member 47 is moved to the outermost position in the left and right directions by the spring urging force, while the holding member 33 is urged so as to be directed along the left and right directions by the urging force of the coil spring 45 (see FIG. 4). As a result, the holding member 33 is in the first state where the tip end portion 35 protrudes to the first position 41.

At the time of mounting the print-receiving paper roll 21, the print-receiving paper roll 21 is received into the second storage part 14 from above such that the tip end portion 35 is pressure contacted (or pushed in) by the outer periphery of the print-receiving paper roll 21, so that the holding member 33 is swung against the urging force of the coil spring 45, resulting in the state where the tip end portion 35 is in contact with the end surface 37 of the print-receiving paper roll 21 (see FIG. 5). As a result, the holding member 33 is in the third state where the tip end portion 35 lies at the end surface position 39, allowing the holding member 33 to retreat from the print-receiving paper roll 21. All the while that the tip end portion 35 is in contact with the end surface 37 of the print-receiving paper roll 21, the holding member 33 is in the third state (see FIG. 5).

When the position of the inner periphery 32 of the core 31 arrives at the position of the tip end portion 35, the holding member 33 is urged to be directed along the left and right directions by the urging force of the coil spring 45 (see FIG. 6). This results in the first state where the tip end portion 35 protrudes to the first position 41 and enters a little into the inner periphery 32, in which state the print-receiving paper roll 21 can temporarily be held. This completes the mounting of the print-receiving paper roll 21.

Subsequently, when the case cover 9 is closed, the upper end of the slide member 47 is pressure contacted (or pushed in) by an edge 55 of the protrusion 53, whereby the slide member 47 slides inward in the left and right directions along the guide member 49 against the urging force of the above described spring, simultaneously allowing the holding member 33 to move inward in the left and right directions. When the case cover 9 is completely closed, the tip end portion 35 protrudes to the second position 43 (see FIG. 7). As a result, the holding member 33 is in the second state where the tip end portion 35 protrudes to the second position 43 and enters to a large extent into the inner periphery 32, in which state the print-receiving paper roll 21 can steadily be held.

<Effects of this Embodiment>

As described above, in this embodiment, upon the mounting of the print-receiving paper roll 21, the holding member 33 is first retreated as the third state from the print-receiving paper roll 21, and then is allowed as the first state to enter a little into the inner periphery 32 of the print-receiving paper roll 21, thereby enabling the print-receiving paper roll 21 to temporarily be held while preventing the interference to the mounting of the print-receiving paper roll 21. Also, when the case cover 9 becomes closed, the holding member 33 is allowed as the second state to enter to a large extent into the inner periphery 32 of the print-receiving paper roll 21, thereby enabling the print-receiving paper roll 21 to steadily be held. Thus, by enabling the holding member 33 to be switched into the above described three state, the print-receiving paper roll 21 can securely be held without impairing the operability in mounting of the print-receiving paper roll 21.

This embodiment has in particular the slide support mechanism 57 capable of supporting the holding member 33 slidably in the left and right directions to switch the advancing/retracting state of the holding member 33 into the first state and the second state. This enables the position of the holding member 33 to securely be switched, by the simple configuration, into the position capable of temporarily holding the print-receiving paper roll 21 and the position steadily holding the print-receiving paper roll 21.

In this embodiment, in particular, the slide support mechanism 57 causes the holding member 33 to slide in conjunction with the action of opening or closing the case cover 9. As a result, when the case cover 9 is opened to load or unload the print-receiving paper roll 21, the position of the holding member 33 can be the position capable of temporarily holding the print-receiving paper roll 21, whereas when the case cover 9 is closed to perform printing operation, the position of the holding member 33 can be the position capable of steadily holding the print-receiving paper roll 21, thereby improving the convenience.

In this embodiment, in particular, when the case cover 9 undergoes the closing action, the slide member 47 supporting the holding member 33 is pressure contacted by the case cover 9 to slide inward in the left and right directions against the urging force of the spring. As a result, there can be implemented the roll holding apparatus 1 capable of switching the position of the holding member 33 into the position allowing the stable holding of the print-receiving paper roll 21, in conjunction with the closing action of the case cover 9.

This embodiment has in particular the swing support mechanism 59 capable of supporting the holding member 33 swingably to switch the advancing/retracting state of the holding member 33 into the first state and the third state. This enables the position of the holding member 33 to securely be switched, by the simple configuration, into the position allowing the print-receiving paper roll 21 to temporarily be held and the position free from interference with the print-receiving paper roll 21.

In this embodiment, in particular, when loading the print-receiving paper roll 21, the holding member 33 is pressure contacted by the print-receiving paper roll 21 so that the holding member 33 swings against the urging force of the coil spring 45, switching to the third state. As a result, there can be implemented the roll holding apparatus 1 capable of switching the position of the holding member 33 into the position free from interference with the print-receiving paper roll 21, in conjunction with the action of loading the print-receiving paper roll 21.

<Modification Example, Etc.>

The present disclosure is not limited to the above described embodiment but may variously be modified without departing from the spirit and the technical idea thereof.

Although in the above described embodiment, for example, description has been given of the cases where, among switches to the above described three advancing/retracting states of the holding member 33, the switch between the first state and the second state is performed by the slide support mechanism 57 and where the switch between the first state and the third state is performed by the swing support mechanism 59, all of the switches to the above described three advancing/retracting states may be performed by the slide support mechanism 57 (without using the swing support mechanism 59). Such a modification example will be described with reference to FIGS. 8 to 11. Portions equivalent or similar to those of the above described embodiment are designated by the same reference numerals and the description of their configurations and actions will appropriately be omitted or simplified.

In this modification example, apart from the above described spring (hereinafter, referred to properly as "first slide spring") urging the slide member 47 outward in the above described left and right directions (in other words, in the above described axial direction), the slide member 47 includes a slide spring (not shown, hereinafter referred to properly as "second slide spring") urging the holding member 33 inward in the above described left and right directions with respect to the slide member 47, with the above described coil spring being omitted. Each holding member 33 is coupled to the corresponding slide member 47 via the above described second slide spring.

In the state where the case cover 9 is opened with the roll 21 being unloaded, the slide member 47 lies outward in the above described left and right directions by the urging force (along the above described axis 22) of the first slide spring, as shown in FIG. 8 corresponding to FIG. 4 described above. At this time, the holding member 33 lies inward in the above described left and right directions by an inward urging force in the above described left and right directions of the second slide spring, resulting in the first state where the tip end portion 35 protrudes to the first position 41 (in other words, penetrates the above described imaginary plane).

In the state where the tip end portion 35 is pressure contacted by the outer periphery of the roll 21, the slide member 47 lies outward in the above described left and right directions by an outward urging force in the above described left and right directions of the first slide spring, in the same manner as the above, as shown in FIG. 9 corresponding to FIG. 5 described above. On the other hand, as a result of sliding of the second slide spring, the holding member 33 slides outward in the above described left and right directions against the inward urging force in the above described left and right directions of that second slide spring, resulting in the above described third state where the tip end portion 35 lies at the end surface position 39 (the tip end portion 35 enters the interior of the holding mechanism 29).

In the state where the position of the inner periphery 32 of the core 31 reaches the position of the tip end portion 35, the slide member 47 lies outward in the above described left and right directions by the urging force of the first slide spring, similar to the above, as shown in FIG. 10 corresponding to FIG. 6 described above. On the other hand, the holding member 33 lies inward in the above described left and right directions by the urging force of the second slide spring, resulting in the state where the tip end portion 35 protrudes to the first position 41 (it enters a little into the inner periphery 32).

In the state where the case cover 9 is closed with the slide member 47 being pressure contacted by the protrusion 53, the slide member 47 slides inward in the above described left and right directions along the guide member 49 against the outward urging force in the above described left and right directions of the first slide spring, as shown in FIG. 11 corresponding to FIG. 7 described above. This allows the holding member 33 to move inward in the above described left and right directions together with the slide member 47, resulting in the second state where the tip end portion 35 protrudes to the second position 43 (enters deeply into the inner periphery 32).

Thus, this modification example can also obtain similar effects to those of the above described embodiment.

If in the above description there are terms such as "vertical", "parallel", and "plane", those terms do not represent their strict meanings. That is, those "vertical", "parallel", "planar", etc., permit allow for tolerances and errors on designing and on manufacturing, and mean "substantially vertical", "substantially parallel" "substantially planar", etc.

If in the above description there are terms such as "same", "equal", and "different" in dimensions or sizes on appearance, those terms do not represent their strict meanings. That is, those "same", "equal", "different", etc., permit tolerances and errors on designing and on manufacturing, and mean "substantially same", "substantially equal" "substantially different", etc.

In addition to the already described ones, the techniques of the above described embodiment and modification examples may properly be combined for use.

What is claimed is:

1. A roll holding apparatus comprising:

a pair of holding members arranged to face each other, and configured to be inserted into an inner periphery of a print-receiving paper roll that includes an outer periphery around which a print-receiving paper to be fed to a printer is wound and configured to rotatably support said print-receiving paper roll; and an advancing/retracting support device configured to support each of said holding members to switch an advancing/retracting state of said holding member among a first state where a tip end portion of said holding member protrudes to a first position, a second state where said tip end portion lies inward along an axial direction of said print-receiving paper roll from said first position, and a third state where said tip end portion lies outward along said axial direction from said first position, wherein an axis of said holding members is co-axial with an axis of said print-receiving paper roll in said first state, said axis of said holding members is co-axial with said axis of said print-receiving paper roll in said second state, said axis of said holding members is not coaxial with said axis of said print-receiving paper roll in said third state, said advancing/retracting support device comprises a slide support device configured to support each of said holding members slidably along said axial direction to switch said advancing/retracting state into at least said first state and said second state, said slide support device comprises:

a guide member disposed along said axial direction;

a slide member configured to support each of said holding members and slide along said axial direction while being guided by said guide member; and a first urging member that urges said slide member outward along said axial direction, said roll holding apparatus is disposed on a case body configured to store said printer, a case cover is supported on said case body in an openable/closable manner, a plurality of protrusions are disposed on said case cover, each of said protrusions includes an edge, said edge makes contact with an upper end of said slide member in a pressured manner when said case cover is closed, and said slide member makes contact with said edge of each of said protrusions in a pressured manner when said case cover is closed, to slide inward along said axial direction against an urging force of said first urging member and cause each of said holding members to slide.

2. The roll holding apparatus according to claim 1, wherein said slide support device is configured to switch said advancing/retracting state into said first state and said second state, and said advancing/retracting support device further comprises:

a swing support device configured to support each of said holding members swingably to switch said advancing/retracting state into said first state and said third state.

3. The roll holding apparatus according to claim 2, wherein said swing support device comprises a second urging member that urges each of said holding members into said first state, and said swing support device is configured to swing each of said holding members against an urging force of said second urging member and switch said advancing/retracting state into said third state, by each of said holding members being in contact with said print-receiving paper roll in a pressured manner at a time of loading said print-receiving paper roll.

* * * * *